United States Patent [19]

Boundy et al.

[11] Patent Number: 4,634,212

[45] Date of Patent: Jan. 6, 1987

[54] TERMINAL BLOCK MOUNT

[75] Inventors: Bruce K. Boundy, Holland; Craig M. Miller, Jenison, both of Mich.

[73] Assignee: Westinghouse Electric Corp., Pittsburgh, Pa.

[21] Appl. No.: 618,629

[22] Filed: Jun. 8, 1984

[51] Int. Cl.[4] ..... H01R 9/22

[52] U.S. Cl. ..... 339/198 R; 339/22 R; 339/24; 174/48

[58] Field of Search ..... 339/24, 23, 22 B, 22 R, 339/198 S, 198 G, 198 GA, 198 H, 21 R, 20, 198 R; 174/48, 49; 52/221

[56] References Cited

U.S. PATENT DOCUMENTS

| | | | |
|---|---|---|---|
| 2,292,394 | 8/1942 | O'Brien | 339/23 |
| 2,983,897 | 9/1963 | Blanchet | 339/198 GA |
| 3,474,392 | 10/1969 | Norden | 339/198 GA |
| 3,559,813 | 2/1971 | Sosinski | 339/198 GA |
| 4,073,563 | 2/1978 | Bailey et al. | 339/198 GA |
| 4,203,639 | 5/1980 | Vanden Hoek et al. | 339/22 R |
| 4,278,834 | 7/1981 | Boundy | 174/48 |

FOREIGN PATENT DOCUMENTS

| | | | |
|---|---|---|---|
| 2736079 | 2/1979 | Fed. Rep. of Germany | 339/198 GA |

*Primary Examiner*—Gil Weidenfeld
*Assistant Examiner*—Thomas M. Kline
*Attorney, Agent, or Firm*—B. R. Studebaker

[57] ABSTRACT

A terminal block mount for mounting a terminal block within a structural frame member. The terminal block includes opposed pressable tab members on the top and bottom sides which permit the terminal block to be snapped into a terminal block receiving aperture in the frame when detents extending into the aperture snap into a space or slot between the opposed tab members. The terminal block can be removed by depressing one of the tab members on each side of the terminal block.

7 Claims, 4 Drawing Figures

TERMINAL BLOCK MOUNT

CROSS-REFERENCE TO RELATED APPLICATION

This application is related to application Ser. No. 618,603, filed June 8, 1984 by Robert L. Russel for PANEL BASE ELECTRICAL RACEWAY U.S. Pat. No. 4593505.

BACKGROUND OF THE INVENTION

This invention relates to the mounting of an electrical terminal block within a frame member and more particularly to the mounting of a terminal block within the raceway structural frame of a space dividing wall panel system.

With the increased use of task lighting, business machines, personal computers and the like in the office environment, almost all space dividing wall panel systems for open office use require the inclusion of an electrical distribution system within the wall panel structure. Copending application Ser. No. 618,603, filed June 18, 1984 for PANEL BASE ELECTRICAL RACEWAY U.S. Pat. No. 4593505, is directed to a novel raceway construction for the distribution of electrical power as well as communication cables in the base of a space dividing wall panel. The terminal block mount of this invention is directed to a novel mechanism for mounting an electrical terminal block within such a raceway.

Office electrical requirements from time to time change and there is a need to be able to easily remove and replace terminal blocks within the raceway system. It is also important that the terminal block, when mounted within the raceway, be specifically oriented with respect to convenience outlet apertures in the panel base covers and the mount must also be rigid to maintain that orientation. Many terminal blocks are presently mounted within their support frames by means of screws, bolts and nuts, or mounting brackets that also must require the use of screws or bolts to maintain the terminal block in a fixed position within the raceway. A terminal block which can be quickly and easily snapped into the raceway frame in a fixed orientation with respect to the remainder of the system and can be equally as simply removed from its mounting location would provide a distinct advantage with respect to both original office setup as well as office rearrangement.

SUMMARY OF THE INVENTION

The terminal block mount of this invention includes frame means having a terminal block receiving aperture therein with detent means on the frame means extending into the terminal block receiving aperture from opposite sides thereof and a terminal block having a pair of opposed sloped flexible tab members on opposite surfaces thereof with each of the pairs of tab members defining a slot therebetween for receiving the detent means. The terminal block is slipped into the terminal block receiving aperture with the opposed detents depressing one of the tab members on each side of the terminal block until the detent slips into the slot between the opposed tab members, thereby retaining the terminal block within the terminal block receiving aperture. Preferably, in addition to the opposed detents, the frame means includes horizontal flange means on each side of the detent means for supporting and locating the terminal block therein and the terminal block includes positioning guide fins on each side of the flexible tabs with the positioning guide fins coacting with the flanges to orient and support the terminal block within the terminal block receiving aperture when the detent means are locked in the slot between the opposed flexible tab members.

BRIEF DESCRIPTION OF THE DRAWINGS

Many of the attendant advantages of the present invention will become more readily apparent and better understood as the following detailed description is considered in connection with the accompanying drawings in which.

DESCRIPTION OF THE PREFERRED EMBODIMENT

Figure 1:
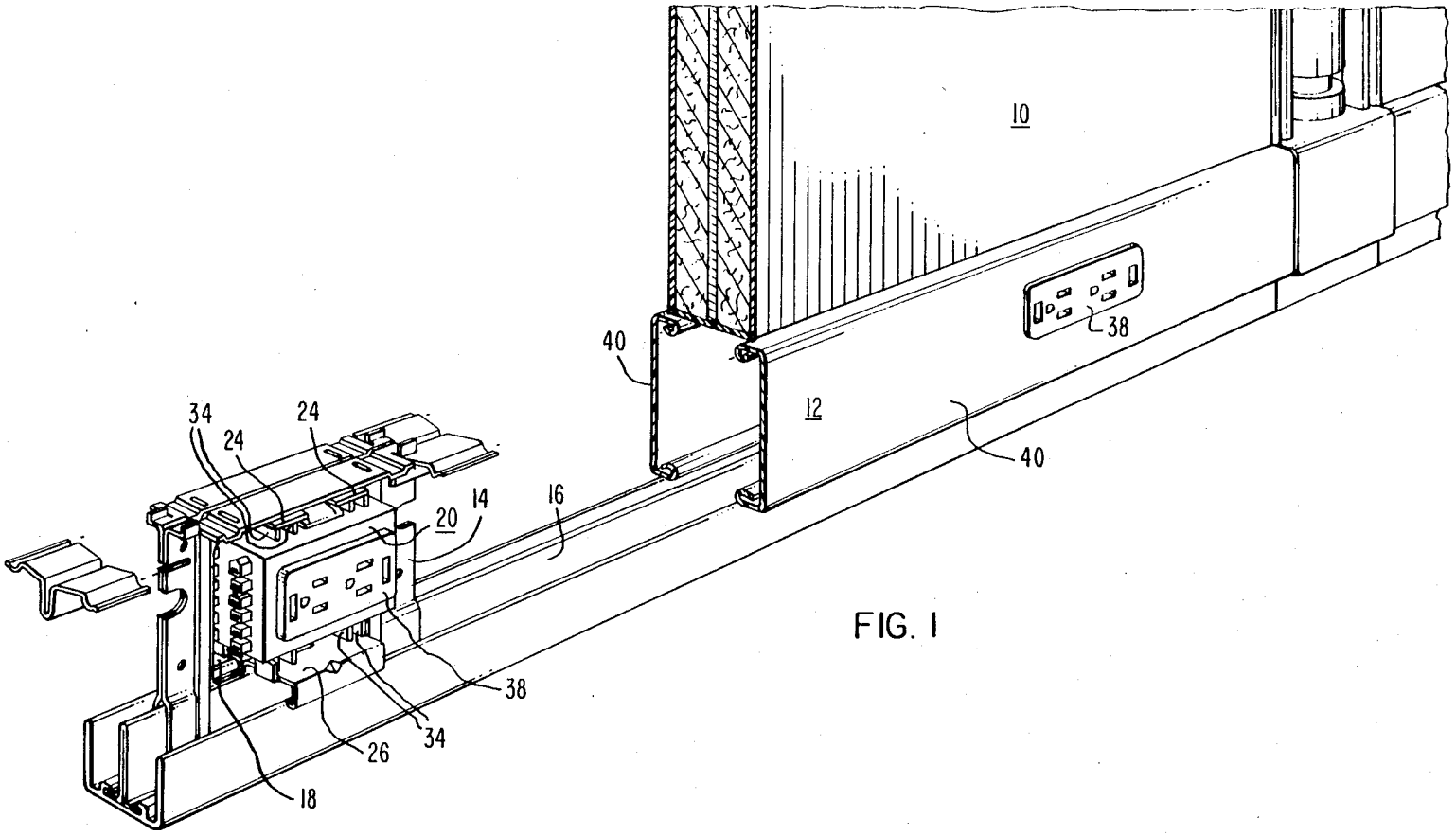
FIG. 1 is a perspective view of a space dividing wall panel and raceway including the terminal block mount of this invention.

Referring now in detail to the drawing wherein like reference characters represent like parts throughout the several views.

There is illustrated in FIG. 1 a perspective view of a space dividing wall panel generally designated 10 having suspended from its bottom edge an electrical raceway of the type disclosed in copending application Ser. No. 618,603, filed June 8, 1984 for PANEL MOUNTED ELECTRICAL RACEWAY U.S. Pat. No. 4593505. The raceway 12 principally comprises a pair of spaced frame members 14 which are interconnected by an elongated inverted T-shaped rail member 16. Each of the frame members 14 include a terminal block receiving aperture 18 therein which serves to mount an electrical terminal block 20 in the raceway 12.

Figure 2:
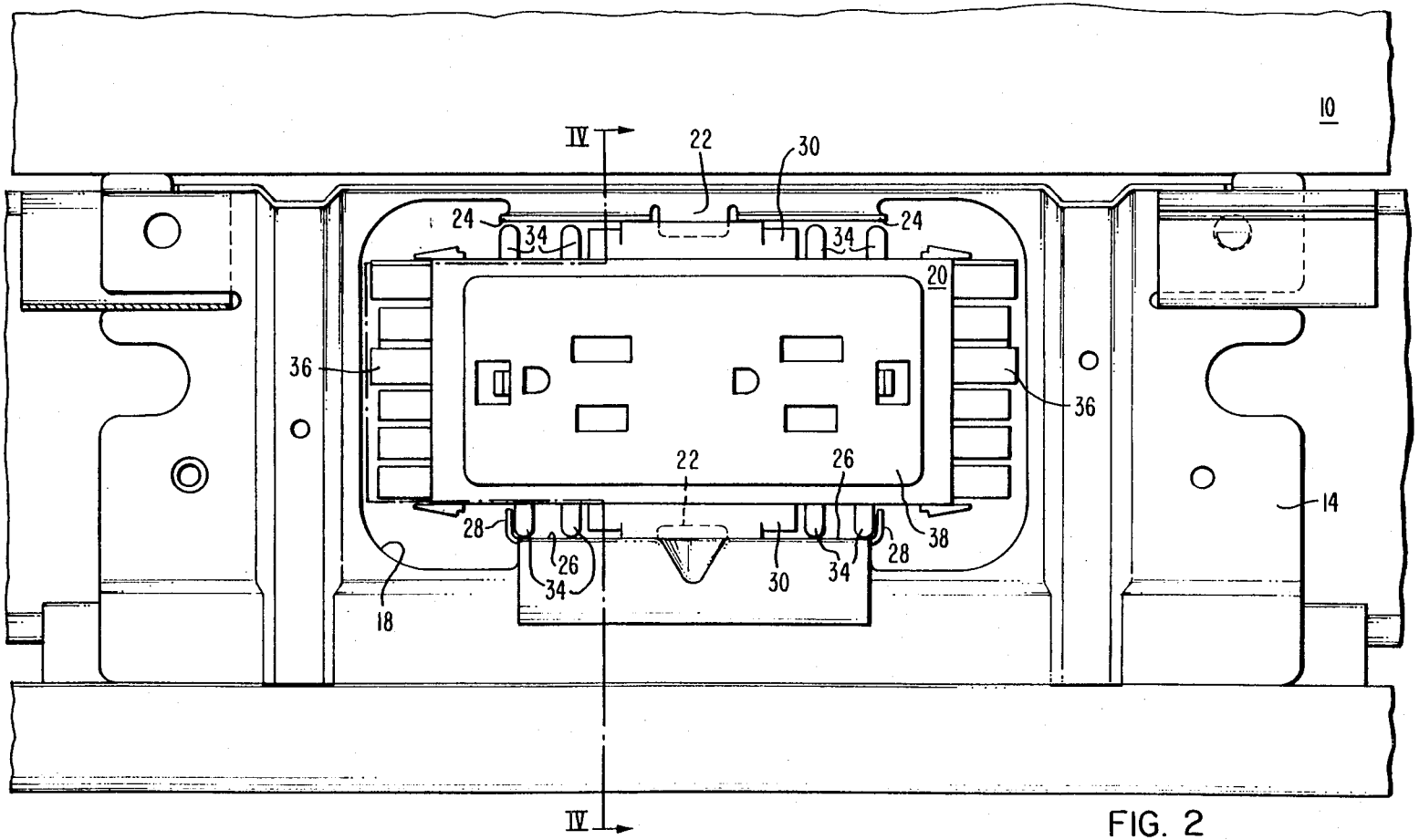
FIG. 2 is a side elevation view of the terminal block mount.
Figure 3:
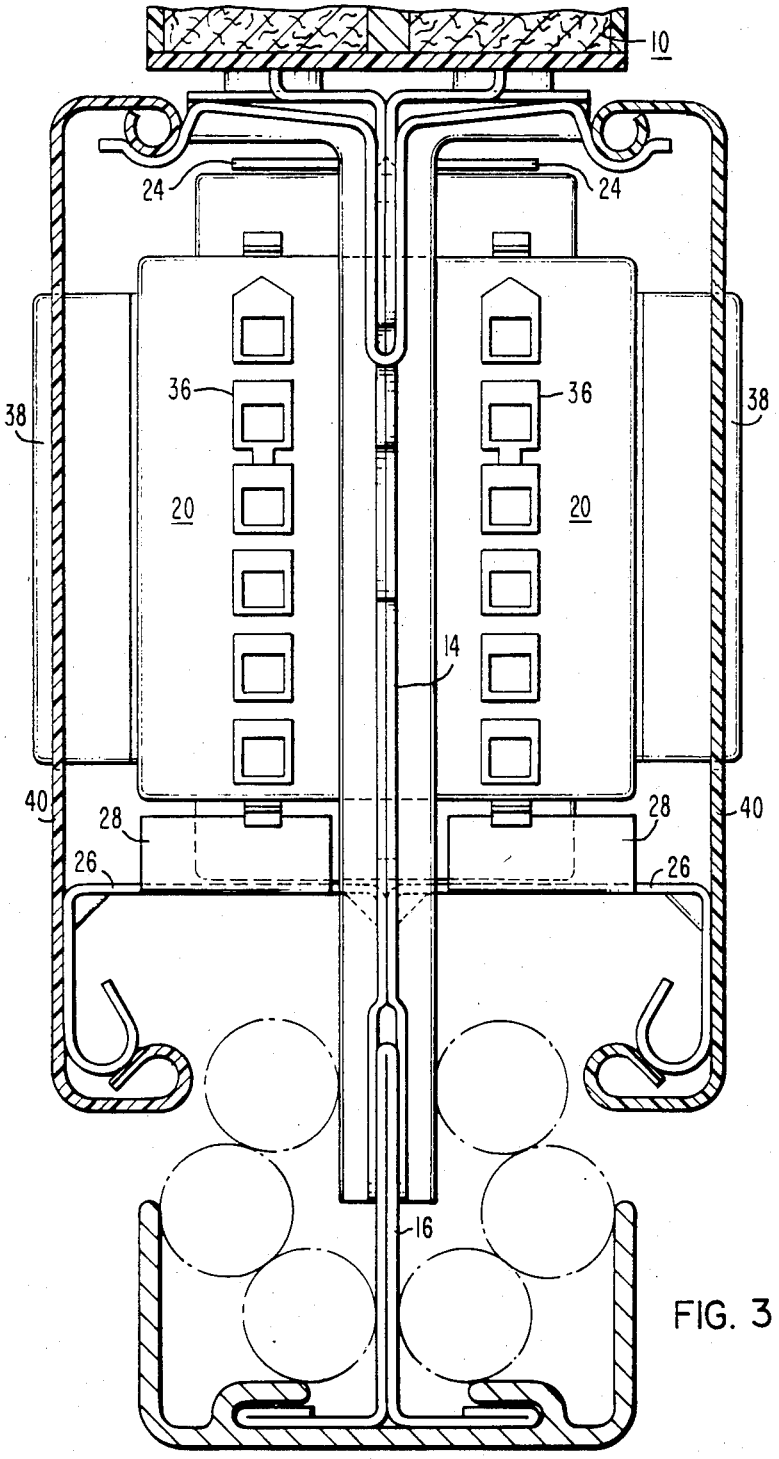
FIG. 3 is an end elevation view of the terminal block mount of this invention.
Figure 4:
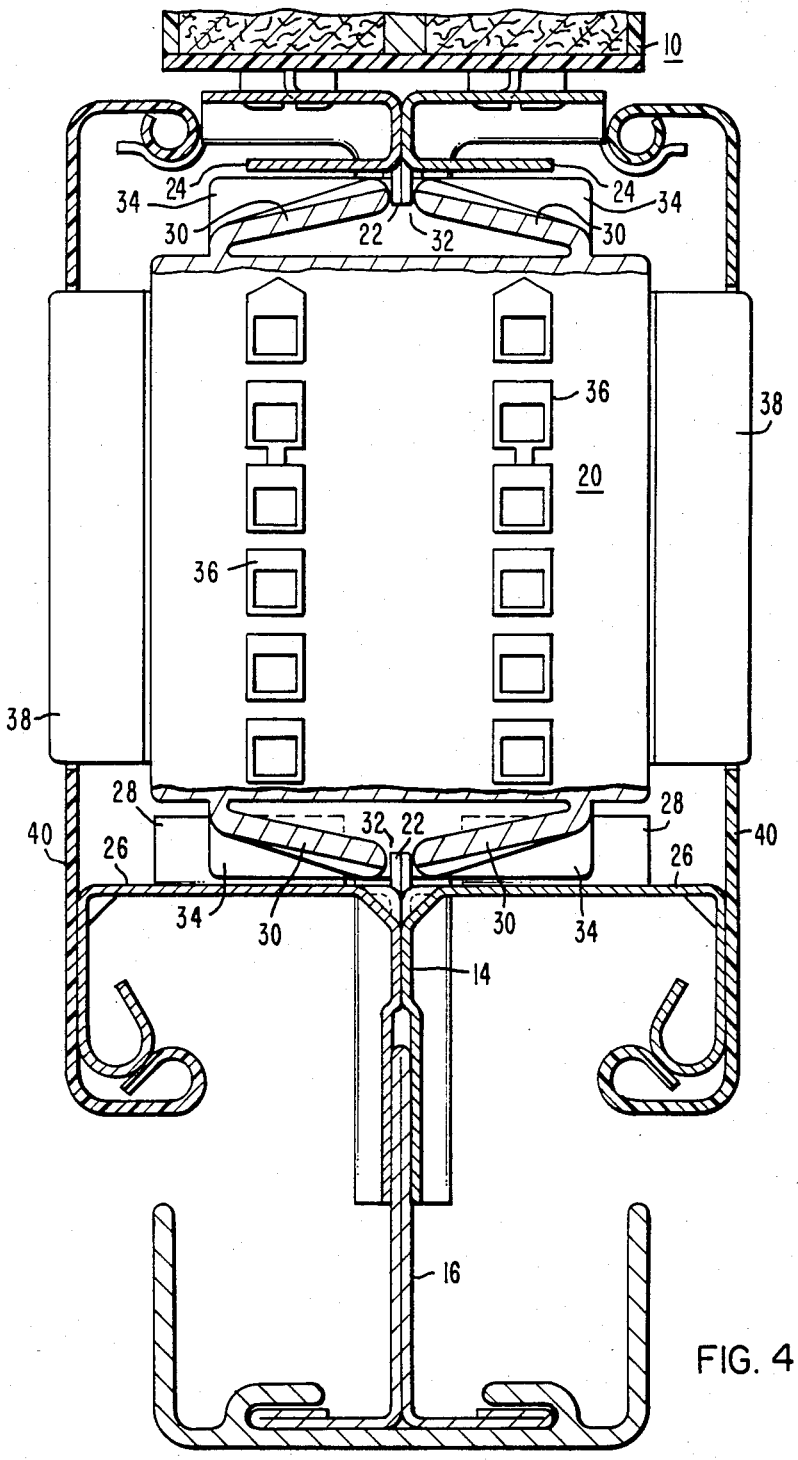
FIG. 4 is a partial sectional view taken along the line IV—IV of FIG. 2.

As best illustrated in FIGS. 2 through 4, the terminal block mount of this invention includes in combination the frame member 14 and the terminal block 20. The frame member 14, which is preferably constructed from two identical parts of 20 gauge cold rolled steel welded back to back to form a unitary structure, includes a pair of rigid detents 22 which extend into the aperture 18 from the top and bottom edges thereof. A pair of planar upper guide flanges 24 are situated on each side of the upper detent 22 and a pair of larger guide flanges 26 are situated on each side of the lower detent 22 and essentially surround the detent. The guide flanges 26 have, at their lateral edges, vertical guide flanges 28 which extend upwardly into the aperture 18 to form a guide in connection with the flanges 24 and 26 for inserting the terminal block 20 into the mounting aperture.

The terminal block 20 has located centrally of its top and bottom surfaces inwardly directed, opposed, sloped, flexible tab members 30 with the inward ends of the tab members 30 forming a slot 32 therebetween. On each side of the flexible tab members 30 are rigid guide fins 34 on both the top and bottom surfaces of the terminal block.

The remainder of the electrical terminal block 20 is essentially conventional and includes male terminal extensions 36 on each end thereof for interconnection with flexible jumper cables (not shown). Since each side of the terminal block is designed to carry three separate circuits interchangeable convenience outlets 38 may be selectively plugged into the side of the terminal block and are constructed and arranged to extend through the base covers 40 of the panel mounted electrical raceway 12.

As will be apparent from the foregoing, the terminal block 20 is placed between the top flanges 24 and the bottom flanges 26 with the outermost guide fins 34 on the bottom of the terminal block sliding within the vertical guide flanges 28. It should be noted that the outermost guide fins 34 on the top surface of the terminal block are spaced slightly farther apart than the outermost guide fins 34 on the bottom of the terminal block to prevent the inadvertent insertion of the terminal block upside down. More specifically, the guide fins 34 on the top side of the terminal block are spaced a sufficient distance apart that they cannot be inserted between the vertical guide flanges 28. By merely exerting thumb pressure on each side of the terminal block, pressing the terminal block 20 into the aperture 18 will cause the detents 22 to depress the flexible tabs 30 on the opposite side of the top and bottom of the terminal block until the detents 22 drop over the ends of the flexible tabs and into the slot 32. With the detents 22 inserted in the space 32 between the ends of the flexible tabs 30 and the outermost guide fins 34 lodged between the horizontal support flanges 24 and 26, the terminal block will be rigidly maintained within the aperture 18 in the proper position for utilization of the convenience outlets 38 through apertures in the base covers 40.

In order to change the terminal block the flexible tab members 30 on one side of the top and bottom of the terminal block are merely depressed with a screwdriver or similar tool and the detent slipped over the depressed tab to quickly and easily remove the terminal block from the support frame.

What is claimed is:

1. A terminal block mount comprising:

frame means having a terminal block receiving aperture therein;

terminal block positioning and locking means located within said aperture at the top and bottom surfaces thereof, said positioning and locking means including detent means extending into said aperture and horizontal flange means on each side of said detent means for supporting and locating a terminal block therein; and a terminal block, said terminal block including a pair of opposed flexible tab members on the top and bottom sides thereof, said opposed flexible tab members defining a detent receiving slot therebetween and positioning guide fins on each side of said flexible tabs, said positioning guide fins coacting with said flanges to orient and support said terminal block within said terminal block receiving aperture when said detent means are locked in said slots between said opposed flexible tab members.

2. The terminal block mount according to claim 1 wherein said positioning guide fins are a plurality of positioning guide fins on each side of said flexible tab members and wherein the outermost positioning guide fins on the top of said terminal block are spaced further apart than the outermost positioning guide fins on the bottom of said terminal block.

3. The terminal block mount according to claim 1 wherein said horizontal flange means on the bottom of said aperture includes vertical guide flanges on each side edge thereof and the outermost positioning guide fins on the top side of said terminal block are spaced further apart than the vertical guide flanges on said horizontal flange means.

4. A terminal block mount comprising:

frame means having a terminal block receiving aperture therein;

rigid detent means on said frame means extending into said terminal block receiving aperture from opposite sides thereof;

planar guide flanges having side edges surrounding said rigid detent means, one of said guide flanges having additional vertical guide flanges extending at right angles to the side edges thereof; and a terminal block having a pair of opposed sloped flexible tab members on opposite surfaces thereof, each pair of tab members defining a slot therebetween for receiving said detent means therein to thereby releasably retain said terminal block in said frame means.

5. The terminal block mount according to claim 4 wherein said terminal block includes positioning guide fins on each side of said flexible tab members, said positioning guide fins coacting with said guide flanges to orient said terminal block within said terminal block receiving aperture.

6. The terminal block mount according to claim 1 wherein said positioning guide fins are a plurality of positioning guide fins on each side of said flexible tab members and wherein the outermost positioning guide fins on the top of said terminal block are spaced further apart than the outermost positioning guide fins on the bottom of said terminal block.

7. The terminal block mount according to claim 5 wherein the outermost positioning guide fins on the top side of the terminal block are spaced further apart than the vertical guide flanges on said lower guide flanges.

* * * * *